United States Patent [19]

Di Leo et al.

[11] 4,394,644

[45] Jul. 19, 1983

[54] PURSE ALARM

[75] Inventors: Angela M. Di Leo, Linden; James Lucia, Morristown, both of N.J.

[73] Assignee: Solomon Zaromb, Hinsdale, Ill.

[21] Appl. No.: 198,120

[22] Filed: Oct. 17, 1980

Related U.S. Application Data

[63] Continuation-in-part of Ser. No. 56,811, Jul. 12, 1979, abandoned.

[51] Int. Cl.[3] ..... G08B 13/14

[52] U.S. Cl. ..... 340/571; 340/542

[58] Field of Search ..... 340/568, 571, 572, 542

[56] References Cited

U.S. PATENT DOCUMENTS 4,118,692 10/1978 Fitchett ..... 340/542

4,155,079 5/1979 Chiu et al. ..... 340/571

*Primary Examiner*—Glen R. Swann, III

*Attorney, Agent, or Firm*—Solomon Zaromb

[57] ABSTRACT

An electric circuit, well concealed within a purse or satchel, comprises an alarm in series with a battery and a switch, said switch being kept open by a uniquely shaped prong inserted into a matching hole. Withdrawal of said prong results in closure of the switch and activation of the alarm. A switching means is recessed within the matching hole in such a manner that mere insertion therein or poking with a sharp-tipped object can not suffice to deactivate the alarm. A cord or wire attachable to both the prong and a part of the owner's body effects withdrawal of the prong, and hence triggering of the alarm, when the purse or satchel is pulled away from said body part, or vice versa, through an action of either a robber or of an owner in distress.

17 Claims, 8 Drawing Figures

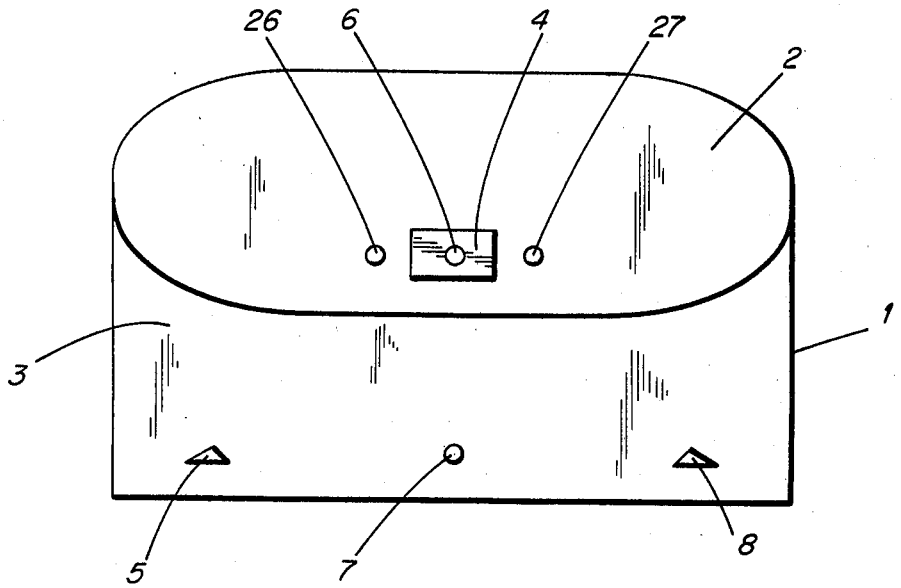
FIG. 1
FIG. 2
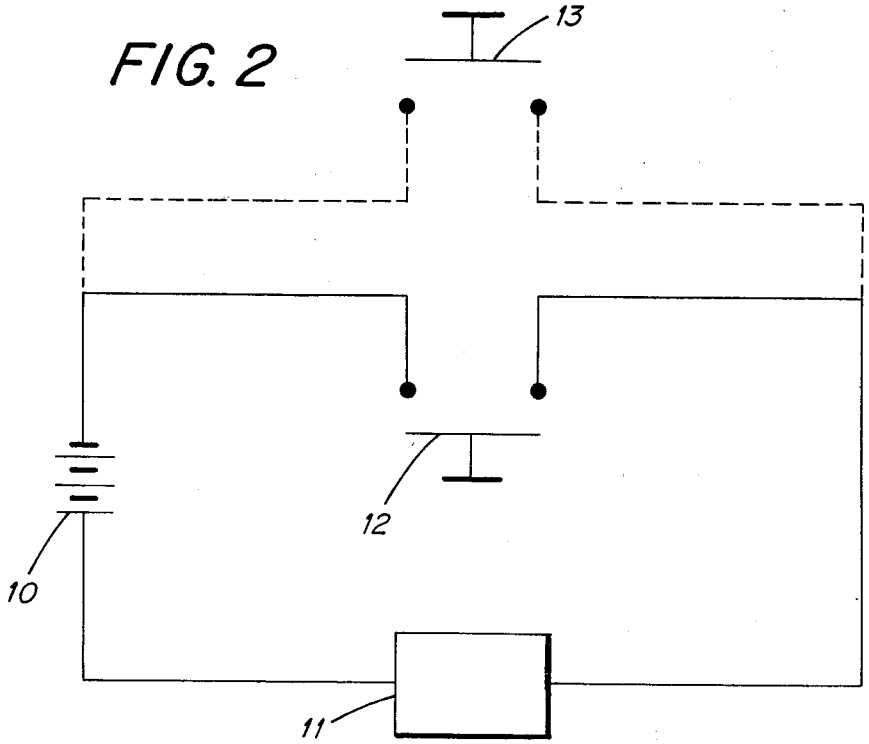

FIG. 3A
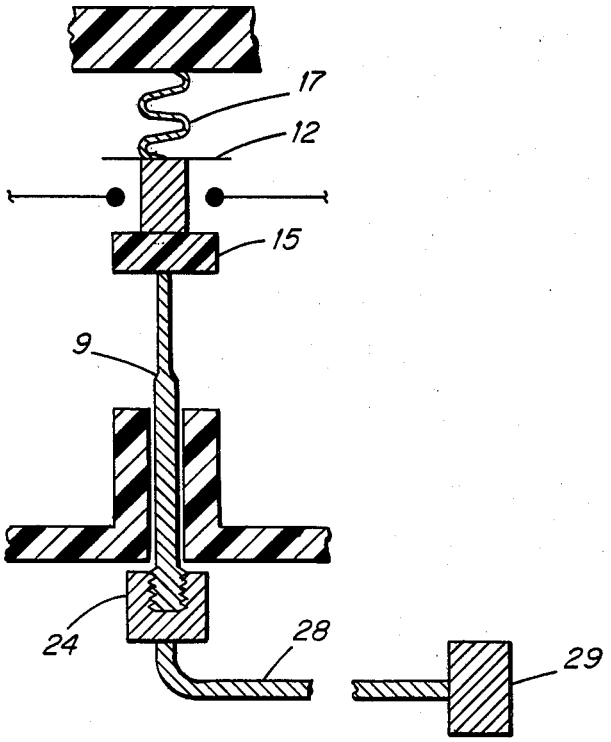
FIG. 3B
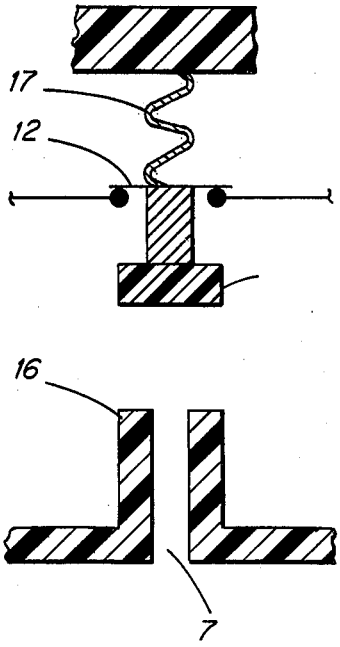
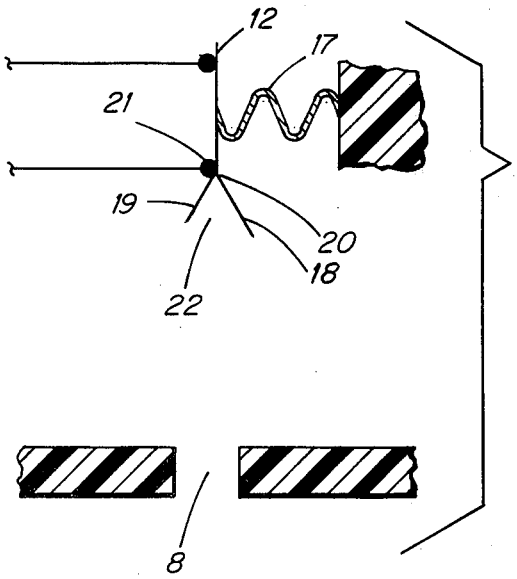
FIG. 4A
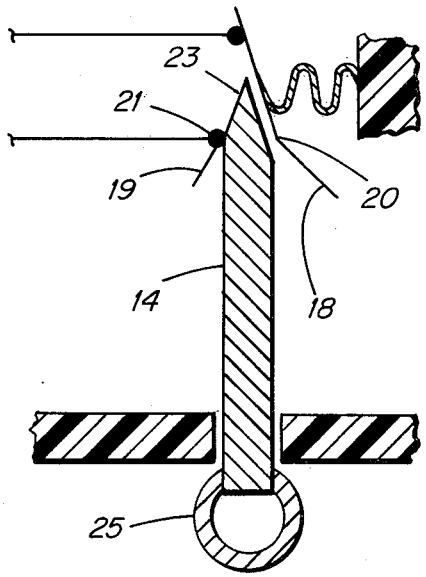
FIG. 4B

FIG. 5
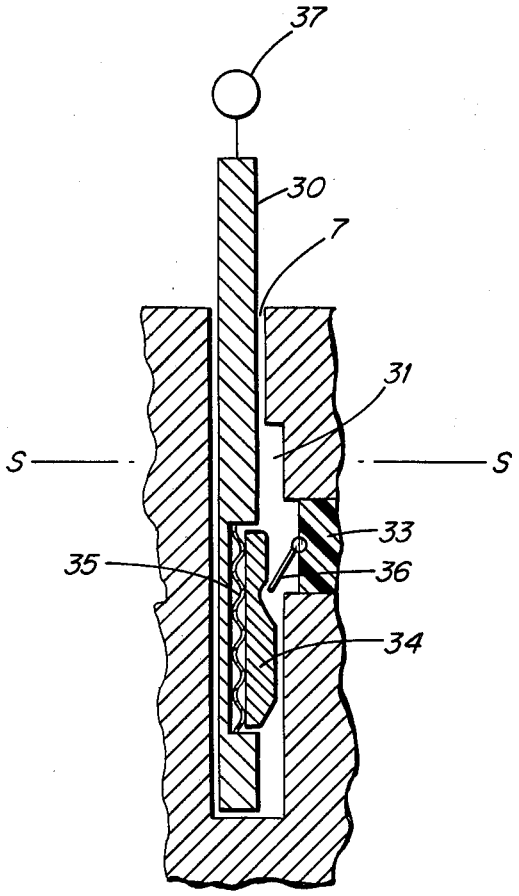
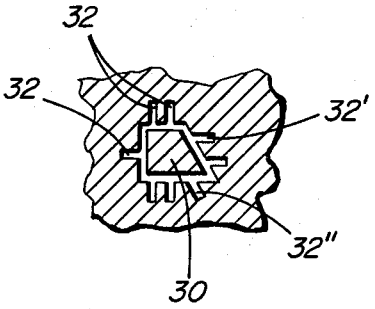
FIG. 6

PURSE ALARM

CROSS-REFERENCE TO A RELATED APPLICATION

This is an continuation-in-part of Applicant Ser. No. 06/056,811, filed July 12, 1979, now abandoned.

BACKGROUND OF THE INVENTION

This invention relates to a purse or satchel containing a concealed alarm device triggered by withdrawal of a prong and inactivated upon reinsertion of said prong.

Various devices have been disclosed for the triggering of an alarm upon unauthorized removal or opening of handbags or other types of purses. Most of these devices, such as those of Tucci et al., U.S. Pat. No. 3,893,096, or Cooper, U.S. Pat. No. 2,461,588, and most of the references cited in said two patents, deal with alarm systems triggered by unauthorized opening of a purse. An alarm actuated by a pulling action on a purse in excess of a predetermined force has been disclosed by Hartley, U.S. Pat. No. 4,067,290. However, this alarm is secured externally to the purse, and can therefore be quickly cut off or torn off the purse by a robber, who might thereafter quietly escape with the loot. Furthermore, Hartley's device can not be readily inactivated by its owner in cases of false alarm, and it requires the replacement of the entire device or at least of a pressurized gas container after each single use.

Another type of alarm actuated by a pulling action on the handle of a purse is taught by Dixon, U.S. Pat. No. 3,701,140. Here the alarm device can not be easily inactivated by a thief, but neither can it be easily deactivated by its rightful owner following an accidental jerking. Moreover, neither Hartley's nor Dixon's device would trigger the alarm in cases where the purse is quietly spirited away without a pulling action after cutting the handle in one or two spots.

For a purse or satchel to be adequately protected against theft or robbery, its alarm should be activated whenever it is separated from its owner by whatever means, whether by brute force or adroit steath. Furthermore, in order for a robber to be motivated to drop his loot and for the purse to be easily retrieved by the police or other pursuers, a continuously sounding alarm should form an integral part of that purse, and this alarm must not be easily inactivated except by its owner.

A "theft-proof suitcase" disclosed by Chiu et al. in U.S. Pat. No. 4,155,079 includes an alarm circuit which is activated upon withdrawal of a jack. However, the device of Chiu et al. must resort to a combination lock located within the suitcase in order to deactivate the alarm. The procedure required for deactivation appears to be cumbersome, rather long-lasting, and hence quite annoying. An owner having to deactivate the alarm in public would be attracting much unwanted attention, and his procedure might be watched and thereafter copied by a thief. Furthermore, some of the elderly persons for whom a purse alarm would be most beneficial may find it difficult to remember the right combination.

Elderly, sickly or otherwise handicapped persons may require assistance on short notice, e.g., when facing an assailant or when in need of help with urgently called for medication in case of sudden recurrence of a serious illness. Such persons could benefit from an alarm which they might easily trigger when finding themselves in trouble. Similarly, even young and healthy women having to walk alone at night might feel safer with an easily activated alarm that could ward off molesters. However, the owner of such a purse alarm should preferably be able to readily activate it and deactivate at will, and repeatedly, without having to go through an elaborate procedure after each single use.

It is therefore an object of this invention to provide an alarm device which can be readily activated and inactivated by its owner, repeatedly if need be, whenever said owner is faced with an emergency requiring the attention of or assistance from any persons within hearing range.

It is a further object of this invention to provide an alarm device forming an integral part of a purse or satchel and not being easily accessible to deactivation by unauthorized persons.

It is yet another object of our invention to provide an alarm system which will be activated whenever a purse or satchel is snatched or otherwise wrongfully separated from its rightful owner by whatever means.

It is still another object of this invention to make it extremely difficult or nearly impossible for an unauthorized person to deactivate the alarm after having wrongfully gained possession of said purse or satchel.

It is still a further object of this invention to provide a personal and handbag protection device that is not only simple to use but also of sufficiently simple construction to render its cost reasonable to its potential users.

SUMMARY OF THE INVENTION

Briefly, our device consists of an electrical circuit comprising an alarm in series with a battery and an on-off switch, said switch being turned off by the insertion of a uniquely shaped prong into an appropriate matching hole, and turned on upon withdrawal of said prong. This circuit is well concealed and preferably locked within a purse or satchel. A cord or string attachable to both the prong and a part of the owner's body effects withdrawal of the prong, thereby triggering the alarm, when the bag is pulled away from said body part, or vice versa, through an action of either a robber or of an owner in distress. The uniquely shaped prong and matching hole are so designed that it is virtually impossible for an unauthorized person to deactivate the alarm by poking into the hole with a sharp-tipped object.

BRIEF DESCRIPTION OF THE DRAWINGS

The invention is best explained with reference to the drawings, in which:

FIG. 1 is a diagrammatic front view of a purse or of the lower part of a satchel;

FIG. 2 is the circuit diagram of the alarm activating-/inactivating means;

FIG. 3 is a partial schematic cross-sectional view in a plane parallel to that of FIG. 1 of one means for opening and closing the switch 12 of FIG. 2, with that switch in both the open (FIG. 3A) and closed (FIG. 3B) positions;

FIG. 4 is a similar partial schematic cross-sectional view of an alternative switching means, with the switch in both the closed (FIG. 4A) and open (FIG. 4B) positions;

FIG. 5 is a partial schematic cross-sectional view of yet another alternative switching means; and FIG. 6 is a partial view of section S—S of FIG. 5.

DESCRIPTION OF THE PREFERRED EMBODIMENTS

FIG. 1 shows a purse 1 having a flap 2 secured to a sidewall 3 by a clasp 4. Several small holes 5, 6, 7, 8, 26, 27 may be disposed in various parts of sidewall 3, clasp 4 or flap 2, only one or two of which may be provided with a prong 9, 14 or 30 (FIGS. 3, 4 or 5) serving to activate or inactivate an alarm.

As shown in FIG. 2, activation or inactivation of the alarm may be accomplished by a simple electrical circuit comprising a battery 10, which may consist of several series-connected cells, an alarm 11, which may be of the buzzer or siren type, and a toggle-switch or a spring-actuated switch 12, e.g., of the pushbutton type, which would usually be kept by its spring in a closed position resulting in the sounding of the alarm. In some instances, as described below, a second switch 13 may be connected in parallel with switch 12, as indicated by the broken lines of FIG. 2.

With the exception of switch 12 and of any additional switch 13, the components of FIG. 2 are well protected in a hidden and preferably locked compartment (not shown) within purse 1.

To inactivate the alarm, switch 12 (and switch 13) must be kept open by inserting prong (or prongs) 9 or 14 through the hole (or holes) 7 or 8 of FIGS. 1 and 3, 4 or 5. As shown in FIG. 3A, the tip of prong 9 pressing against the button 15 of push-button switch 12 causes the latter to be open, thereby inactivating the alarm. Prong 9 fits within the wall 16 of hole 7 snugly or tightly enough to resist the force of the spring 17 which would tend to close switch 12 in the absence of prong 9, as indicated in FIG. 3B.

An alternative switching means for activating or inactivating the alarm by withdrawing or reinserting prong 14 is illustrated in FIGS. 4A and 4B. In FIG. 4A, the alarm-activating switch 12 is kept by spring 17 in its normally closed state. The outward-oriented ends 18 and 19 of switch contacts 20 and 21 are bent back so as to form a V-like groove 22 when these contacts are brought together. To inactivate the alarm, an electrically insulating prong 14, made of a stiff plastic material or of any other suitable insulator, and having a wedge-shaped tip 23, is pushed through groove 22 so as to separate the contacts 20 and 21, thereby opening the switch, as indicated in FIG. 4B.

As shown in FIG. 1, the hole 8 should be at least partly asymmetrical, e.g., of the shape of a non-equilateral triangle, pentagon, trapezoid, or other asymmetric polygon or curve, such as two unequal intersecting circles or ovals, so that a prong of the same shape could fit into it in only one way, thereby assuring smooth passage of wedge-shaped tip 23 through groove 22.

The partly asymmetric shape of prong 14 and its matching hole 8 permits it to function somewhat like a key, making it difficult for an unauthorized person to inactivate the alarm with some sharp-tipped instrument of his own.

Even more difficult to deactivate by unauthorized persons is the embodiment illustrated in FIGS. 5 and 6. In FIG. 5 is shown a prong 30 fully inserted within a matching hole 7. The lower portion 31 of hole 7 comprises a plurality of recessed grooves 32, as indicated in FIG. 6, only one of which, say groove 32', contains a concealed toggle switch 33. A tab 34 within prong 30, caused by a leaf-spring 35 to protrude into groove 32' as soon as prong 30 has been inserted to a sufficient depth, engages the toggle 36 of switch 33 each time the prong is fully inserted into or withdrawn from hole 7. Full insertion of prong 30 causes toggle 36 to be in the downward or off position, as indicated in FIG. 5, resulting in the inactivation of the alarm. As prong 30 is withdrawn, the tab 34 engages toggle 36 and throws it in the upward position, thereby causing closure of switch 33 and hence activation of the alarm. As tab 34 encounters the upper groove-free portion of hole 7, it gets temporarily pushed against spring leaf 35 and remains approximately flush with the wall of the prong until said upper portion is cleared. Of course, more than one tab 34 may be used to inactivate or activate one or more switches 33.

As shown in FIG. 6, prong 30 and hole 7 have an asymmetric shape, so that there is only one proper way of inserting the prong into the hole. However, the multiplicity of concealed recessed grooves 32 makes it extremely difficult for an unauthorized person to locate the right groove 32' and to engage toggle 36 in any attempts to deactivate the alarm by poking into the hole with a sharp-tipped hook or similar object.

In addition, extra dummy holes 5, 6, 26 or 27 may be included in purse 1 for the purpose of confusing any thief attempting to deactivate the alarm. Furthermore, a second alarm-activating switch 13 may be added to the circuit, as indicated in FIG. 2, in which case inactivation of both switches would require a second tab 34' (not shown) engaging a second toggle 36 (not shown) in a second groove 32'' in the embodiment of FIGS. 5 and 6 or else two separate uniquely shaped prongs or a special two-pronged jack, neither of which could be readily duplicated by an unauthorized person.

Even more difficult to duplicate or deactivate by a mugger is the embodiment of FIGS. 5 and 6 wherein two toggleswitches are concealed in two grooves 32', 32'', and wherein said toggle switches are caused by springs (not shown) to revert to the closed position in the absence of the matching prong. Under these conditions, even if a mugger succeeded in locating the toggles of both switches, he would still have a very hard time trying to keep both switches open so as to deactivate the alarm.

For protection against unauthorized opening of the purse or satchel, one of the prongs may fit through a hole in flap 2 or clasp 4, e.g., hole 6 of FIG. 1, so that partial withdrawal of the prong caused by opening the flap or the clasp would result in closure of switch 12 or 13, and hence in the activation of the alarm. For such partial withdrawal to be effected by opening the flap or the clasp, the exterior end of prong 9 should be either larger than opening 7 or be attached to a somewhat larger cap 24, as indicated in FIG. 3A.

Of course, the side of the purse or satchel containing the holes and the matching prongs should be preferably held against the owner's body so as to render the holes and prongs inconspicuous.

Either the screw-cap 24 of FIG. 3A or a permanent hole, ring or loop, such as ring 25 of FIG. 4B or 37 of FIG. 5, may be used to effect withdrawal of prong 9, 14 or 30 in order to activate the alarm. Screw-cap 24 may be permanently attached to a string or cord 28, made of natural fiber, plastic or wire, which may in turn be attachable to a part of the owner's body via a belt, wrist strap, bracelet or even part of the underwear. To make it difficult for an assailant to forcibly retrieve the inactivating prong, the string or cord 28 may be attached to a small ratchet-controlled spring-wound reel 29 hidden under the owner's garment, so that a jerking action on the string or cord would release the ratchet (not shown) and pull the prong under the garment. Spring-wound mechanisms activated by a jerking action are, of course, well known in the mechanical arts, being commonly used in fishing reels and in certain types of window shades.

If a permanent hole, loop or ring 25 or 37 is provided near the exterior end of the inactivating prong, then string or cord 28 may be either looped through it directly or connected thereto via a closeable hook or chain link whenever the owner wishes to keep the alarm in readiness.

In either case, when the purse or satchel is to be stashed away or otherwise put aside, the string or cord 28 may be detached from the prong by untying it or otherwise detaching it from ring 25 or by unscrewing cap 24. The free prong thus remains inserted in its hole to keep the alarm inactivated.

There will now be obvious to those skilled in the art many modifications and variations of the afore-disclosed alarm device, which, however, shall remain within the scope of our invention if defined by the following claims:

We claim:

1. In a battery-powered alarm device comprising a switch connecting a battery to an alarm so as to activate the latter, said battery, alarm, and switch being enclosed within a purse, satchel or any other type of bag, the improvement comprising a switch means for keeping said alarm from being activated and for deactivating said alarm once it has been activated by opening said switch and keeping said switch open through the insertion of a prong uniquely shaped into a matching hole within said purse, satchel or other bag and for activating said alarm upon withdrawal of said prong, said prong being insertible and withdrawable externally to said bag, and said switch means being recessed and substantially concealed within said matching hole in such a manner that mere insertion therein of or poking with a sharp-tipped object other than said uniquely shaped prong can not bring about the opening of said switch to deactivate said alarm.

2. The alarm device of claim 1, comprising means for attaching said prong to a part of the human body when said purse or satchel is being carried and for detaching said prong while leaving it inserted in said matching hole when said handbag is to be put aside.

3. The alarm device of claim 2, wherein the attachment of said prong to said body part is effected via a string or cord.

4. The alarm device of claim 3, wherein said attachment comprises (a spring-wound reel controlled by a rachet,) pulling means for causing said prong to be drawn close to said body part when a jerking action is exerted on said string or cord.

5. The alarm device of claim 4, wherein said pulling means comprises a spring-wound reel.

6. The device of claim 5, wherein said reel is controlled by a rachet or rachet-like mechanism.

7. The alarm device of claim 3, wherein said string or cord is attached to a cap which can be screwed on or off the stem of said prong.

8. The alarm device of claim 3, wherein said string or cord is attached through a loop or opening at the stem of said prong.

9. The alarm device of claim 3, wherein said handbag comprises several holes, only one or some of which serves or serve for the insertion of the deactivating prong or prongs.

10. The device of claim 9, wherein more than one hole serves to accomodate deactivating prongs, and wherein said prongs form either part of a single multi-pronged jack or are each separately attached to said string or cord.

11. The device of claim 10, wherein closure of said handbag is effected by means of a cover, and wherein one of said deactivating prongs is inserted through a hole in said cover, so that unauthorized opening of said cover would cause withdrawal of the latter prong, thereby actuating the alarm.

12. The alarm device of claim 1, wherein said switch is kept normally closed by a spring and the tip of said prong is made of an electrically insulating material, and wherein the full insertion of said prong through said matching hole results in wedging of said tip between the electrical contacts of said switch, and hence in the separation of said contacts, thereby keeping said switch open and the alarm inactivated.

13. The alarm device of claim 1, wherein said switch is a toggle switch, and the toggle of said switch is concealed in a recessed groove, and said prong comprises one or more protrusions which engages or engage with said toggle so as to open said switch and deactivate said alarm when said prong is fully inserted and to throw the switch in the closed position and thereby activate the alarm when said prong is withdrawn.

14. The alarm device of claim 13, wherein said protrusion or protrusions is or are pushed into said recessed groove by a springy means.

15. The alarm device of claim 13 wherein said matching hole comprises a plurality of recessed grooves only one or some of which may comprise a concealed switch.

16. The alarm device of claim 15 comprising at least two concealed switches in said recessed grooves, and wherein said protrusions engage with the toggles of both switches to activate and deactivate the alarm upon withdrawal or reinsertion of said prong.

17. The alarm device of claim 16, wherein said toggle switches are caused by spring means to normally revert to the closed position in the absence of said prong.

* * * * *